US006920908B2

(12) United States Patent
Niehausmever

(10) Patent No.: US 6,920,908 B2
(45) Date of Patent: Jul. 26, 2005

(54) FOLDING DEVICE AS ROOM DIVIDER OR ROOM CLOSURE

(75) Inventor: Uwe Niehausmever, Rödinghausen (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 0 days.

(21) Appl. No.: 10/249,971

(22) Filed: May 23, 2003

(65) Prior Publication Data

US 2003/0217817 A1 Nov. 27, 2003

(30) Foreign Application Priority Data

May 24, 2002 (DE) ..... 102 23 263
Aug. 1, 2002 (DE) ..... 102 35 299

(51) Int. Cl.[7] ..... E06B 7/16
(52) U.S. Cl. ..... 160/40; 160/118
(58) Field of Search ..... 160/40, 118, 117, 160/119, 199, 206, 209; 52/71, 65; 49/475.1

(56) References Cited

U.S. PATENT DOCUMENTS 4,133,365 A * 1/1979 Schleicher ..... 160/118
5,042,554 A * 8/1991 Schmidt ..... 160/199
5,199,478 A * 4/1993 Kubota ..... 160/40
5,299,791 A * 4/1994 Schlapp ..... 296/219
6,220,332 B1 * 4/2001 Lai ..... 160/199

* cited by examiner

*Primary Examiner*—Blair M. Johnson
(74) *Attorney, Agent, or Firm*—Gudrun E. Huckett

(57) ABSTRACT

A folding device as a room divider or room closure has at least one wing chain of interconnected wings that upon opening of the folding device are folded against one another. One wing side has guide elements received in guide rails such that the wings are slidably guided. One wing is an opening wing connected only to a single neighboring wing and has a free wing edge guided in the guide rails. The guide elements on the free wing edge of the opening wing have a hinge, respectively. The hinges have a first end connected to the opening wing and a second end connected to holding elements in the guide rails. The free wing edge has a fixed profiled strip arranged between the holding elements. The profiled strip covers at least a width of the holding elements outside of the guide rails.

17 Claims, 17 Drawing Sheets

FOLDING DEVICE AS ROOM DIVIDER OR ROOM CLOSURE

BACKGROUND OF INVENTION

1. Field of the Invention

The invention relates to a folding device, in particular, a folding device with glass panes, comprised of wings having peripheral metal profiles filled preferably with glass panes and a peripheral frame usually comprised of metal profiles, for room dividers or room closures to be opened and closed as needed, for example, for sunrooms, business entrances, balcony enclosures or the like. The folding device comprises a series of wings connected to one another to form at least one wing chain, wherein the wings, for opening the device, are folded against one another, wherein each wing is pivotably connected to a neighboring wing within the wing chain and is slidably guided with one side, respectively, by means of guide elements in guide rails or is secured on lateral frames in a non-slidable but pivotable way. At least one wing is an opening wing being connected only with one side to a neighboring wing and having a free wing edge on the opposite side that is guided in the guide rail.

2. Description of the Related Art

In principle, such folding devices have one or several pivotable and slidably connected wing chains so that a large front of a building or a room divider can be opened almost completely. Within the wing chain, each wing is pivotably connected to the neighboring wing but is guided slidably only with one side in the guide rails. The outer wings of a wing chain are either configured as opening wings, having one side without connection to another neighboring wing, or are secured pivotably and usually non-slidable on a lateral frame. When the opening wing is an individual wing, it can be configured simply as a rotary wing wherein the side connected to the neighboring wing is guided in the guide rails while the free wing edge is pivoted out of the plane which is formed by the guide rails and the lateral frame.

On the other hand, when the opening wing of the folding devices of the aforementioned kind is part of a double wing, i.e., a wing of a wing pair, its free edge must be guided in the guide rail. Because of construction prerequisites, the folding or pivot axes of the guide elements, provided for guiding the wings in the guide rails, must be arranged symmetrically between two neighboring, pivotably connected wings within the wing chain. Because the hinge parts required for the function of the device are arranged between the wings, in the closed state of the folding device a gap is formed which is closed by seals in order to fulfill the requirements with respect to draft prevention and heat insulation. When the guide element is arranged on the free wing edge of the opening wing, the guide element is positioned at the same spacing to the wing edge as in the arrangement within the wing chain and thus projects past the free wing edge. In order to enable a smooth end toward the neighboring wing or frame, generally a post is connected so as to be slidable to the free wing edge of this opening wing, the so-called pair end member, wherein the post remains in the frame plane defined between the guide rails. It represents essentially an additional wing which is reduced simply to the frame width.

Since the described folding devices are mostly embodied as folding devices with glass panes, a transparency as large as possible is desired, i.e., the view obstructing portion of the folding device caused by the frames and profiles should be as minimal as possible. However, the posts which have been used in the past increase the view obstructing portion of the vertical profiles at this location; this is not desired by architects and planners as well as consumers and users. In particular, when two opening wings of wing pairs meet one another, the view obstructing portion is undesirably large because of the two additional posts.

SUMMARY OF INVENTION

It is an object of the present invention to configure a folding device of the aforementioned kind such that it provides a constructively light visual appearance with a minimal view obstructing portion.

In accordance with the present invention, this is achieved in that the guide elements on the free wing edge of the opening wing have a hinge which is connected with one end to the opening wing and with the other end to a holding element and wherein the free wing edge between the holding elements has a profiled strip between the holding elements covering at least the width of the holding elements outside of the guide rail and being immobile relative to the opening wing.

The configuration of the guide elements provided on the free wing edges of the opening wing or opening wings comprising a hinge having at its free side a holding element and including covering of the intermediate space between the holding elements by means of the profiled strip connected fixedly at least to the opening wing, enables elimination of the conventionally used post. The connection of the free wing edge of the opening wing is realized simply by means of the holding elements which can be configured without problems and without any loss of stability with a very minimal height. The laterally projecting width of the holding elements can also be much smaller than that of the conventionally employed posts so that, even with the profiled strip connected to the opening wing, a significantly reduced view obstructing portion results. Since the profiled strip upon opening of the wings pivots together with the opening wing, the view obstructing portion or width is further reduced in the open state of the folding device.

A very slim configuration can be achieved when the holding element is configured as a unitary part together with the hinge part of the guide element connected thereto.

Preferably, the side of the free wing edge facing the hinge as well as the opposite side of the free wing edge of the opening wing are provided with profiled strips. The profiled strips can form a monolithic part with one another and/or with the wing edge.

DETAILED DESCRIPTION

Figure 1A:
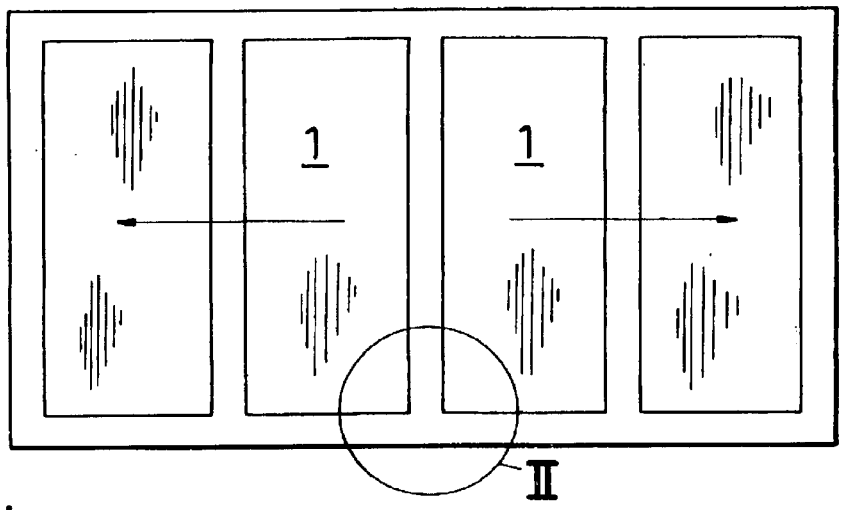
FIGS. 1*a–e* show schematically a folding device having four wings in a closed position in a frontal view and, in section, in several closing and opening positions.
Figure 1B:
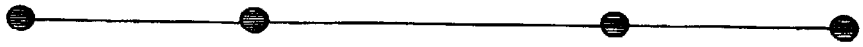
Figure 1C:
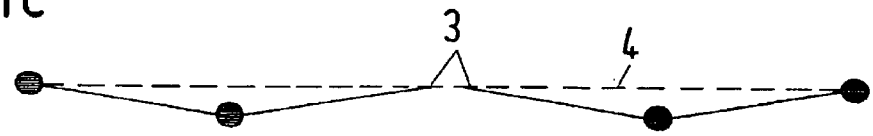
Figure 1D:
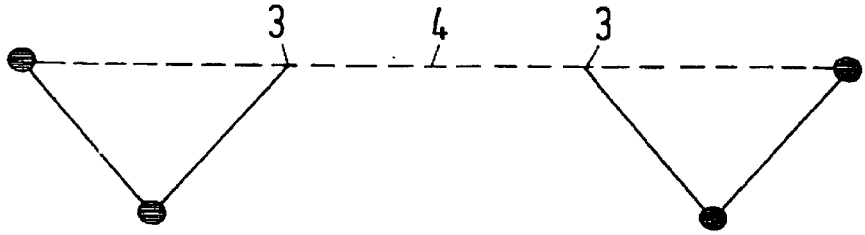
Figure 1E:
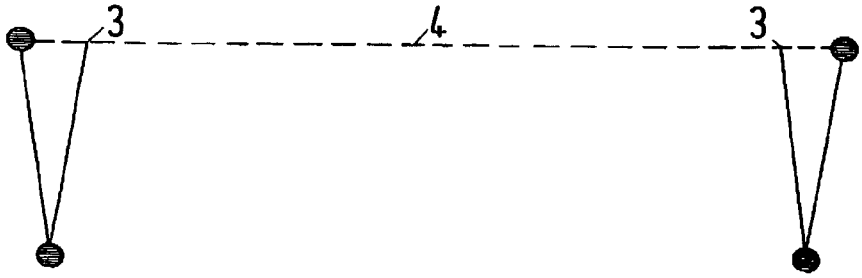

FIG. 1*a* shows a four-wing folding device with two wing pairs. Opening of this device is illustrated in pictograms in FIGS. 1*b* through 1*e*. The two free wing edges 3 of the opening wing 1 always remain in the plane 4 defined by the guide rails (not illustrated); this plane is indicated by dashed lines.

Figure 2:
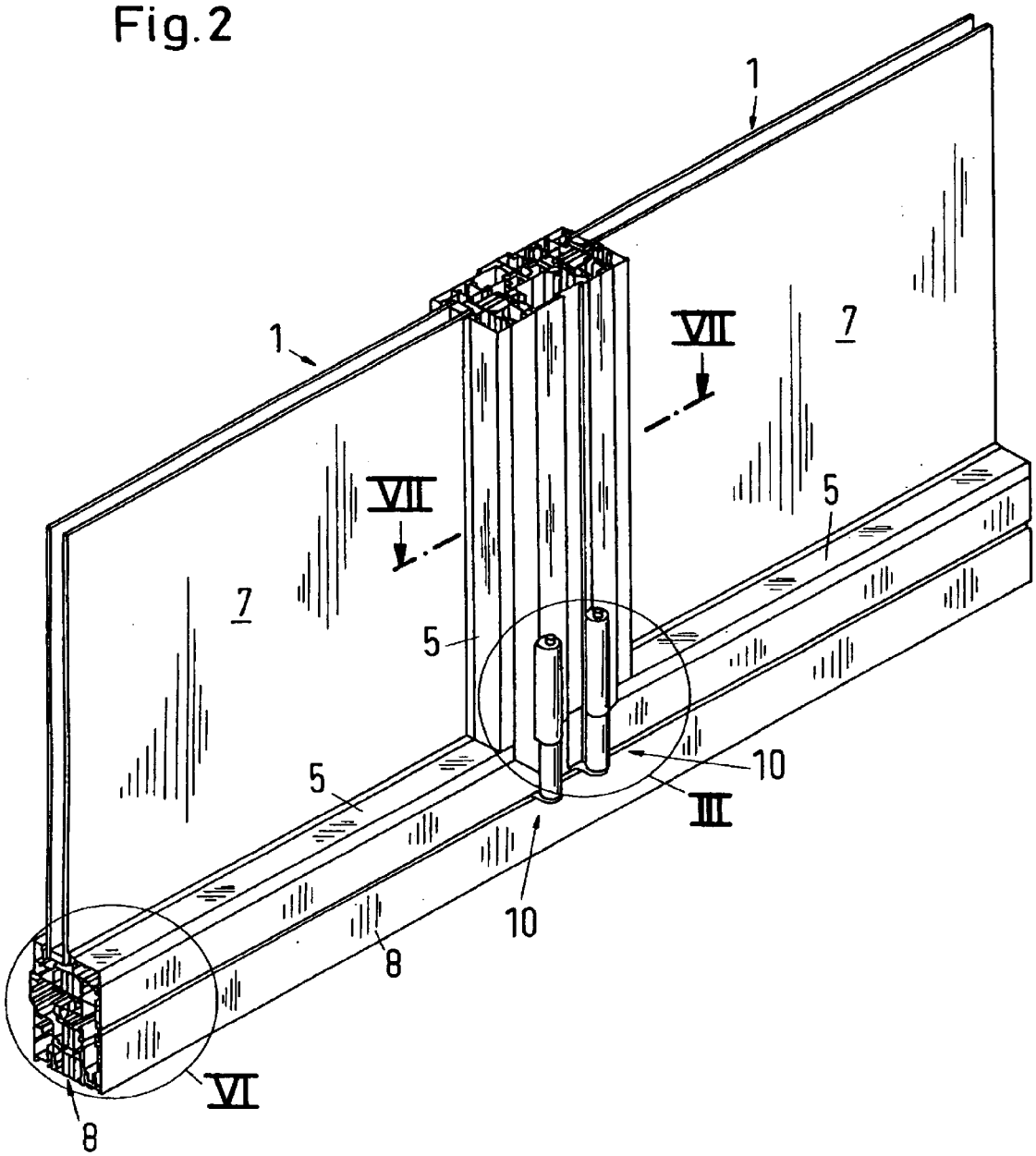
FIG. 2 shows the lower central opening area, corresponding to detail II of FIG. 1, in a perspective illustration.

FIG. 2 shows the lower central area of the abutting two free edges of the opening wings 1 of the folding device. The opening wings 1 of the folding device in the illustrated embodiment open inwardly relative to the position of the viewer of FIG. 2. The opening wings 1 are comprised of double pane panels 7 framed in wing frames 5. The wings are slidably guided at the top and bottom in guide rails 8 by means of guide elements. The embodiments are illustrated in more detail in the following Figures.

The configuration according to the Invention is best illustrated in FIGS. 6 through 10*a*–10*d*. The inventive configuration is characterized in that the guide elements 10 have a hinge 11 which is connected with one end by conventional fasting means 12 to the opening wing 1 and with the other end is connected to a holding element 13 which remains within the guide rail 8 even when the wings are opened. Since the holding element 13 extends with portions thereof along the frame 5 and also outside of the guide rail 8 and projects laterally past the axis 14 of the hinge 11, the opening wing 1 has profiled strips 15, 16 which cover at least the width B of the holding element 13. On the side of the holding element 13 the profiled strip 15 extends into the area between the upper and the lower holding elements 13 while the profiled strip 16 extends on the opposite side across the entire height of the opening wing 1. Both profiled strips 15, 16 are fixedly or non-moveably connected to the opening wing 1 so that they follow the pivoting movement of the opening wing 1 for opening or closing the folding device (FIGS. 8*a*–8*c*), while the holding element 13 stays in the plane 4 between the guide rails 8. For this reason also, for preferably has only a minimal height. The height corresponds preferably and for construction reasons simply to the height H (see FIG. 3 ) of the hinge part 11' facing the guide rail 8. For a visual appearance as pleasing as possible, the holding element 13 should have maximally the height h of the frame 5. In a particularly compact and therefore preferred embodiment, the holding element 13 is a monolithic part of the hinge part 11' connected to it.

Figure 3:
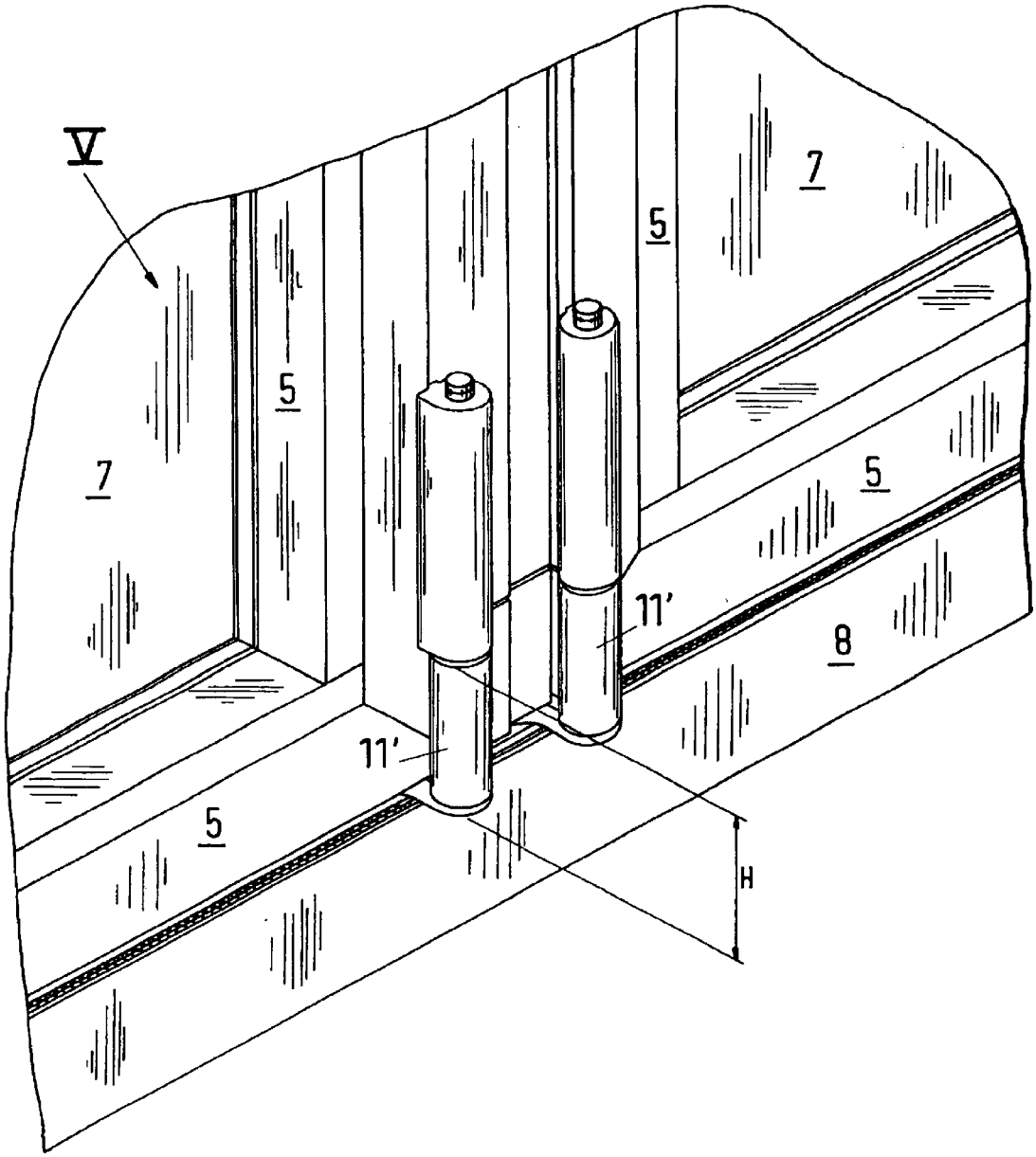
FIG. 3 shows the detail III of FIG. 2.
Figure 4:
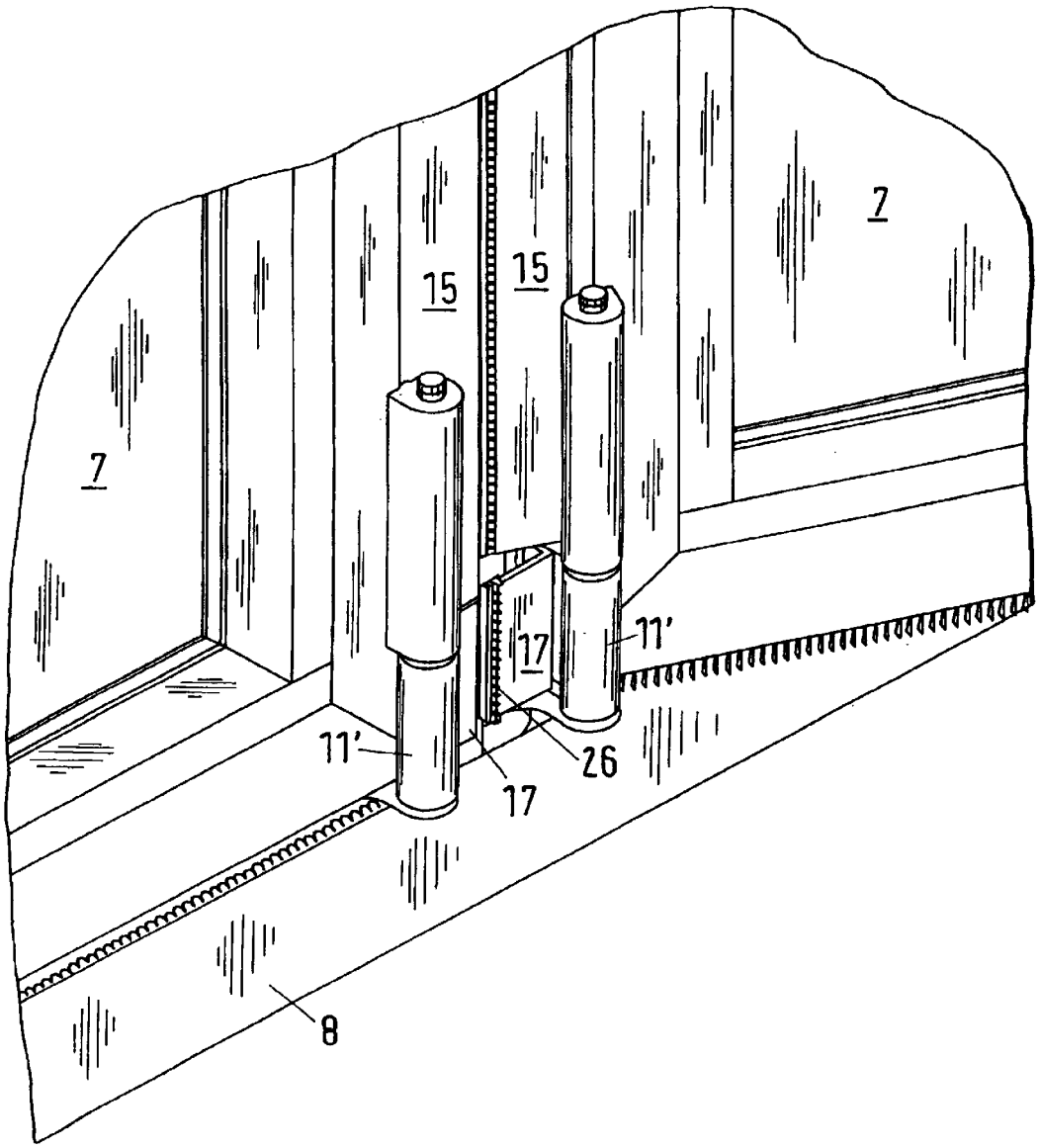
FIG. 4 illustrates the object of FIG. 3 when opening the folding device.

When the holding element 13 is not already matched with its basic configuration according to the plan view in the direction I to the profiled strip 15, it should be provided with a strip part 17 matching the profiled strip 15 in order to provide a visually uniform configuration. This strip part 17 together with the holding element 13, as illustrated in FIGS. 3 and 4, remains in the plane 4 of the guide rail 8 when opening a wing.

Figure 5:
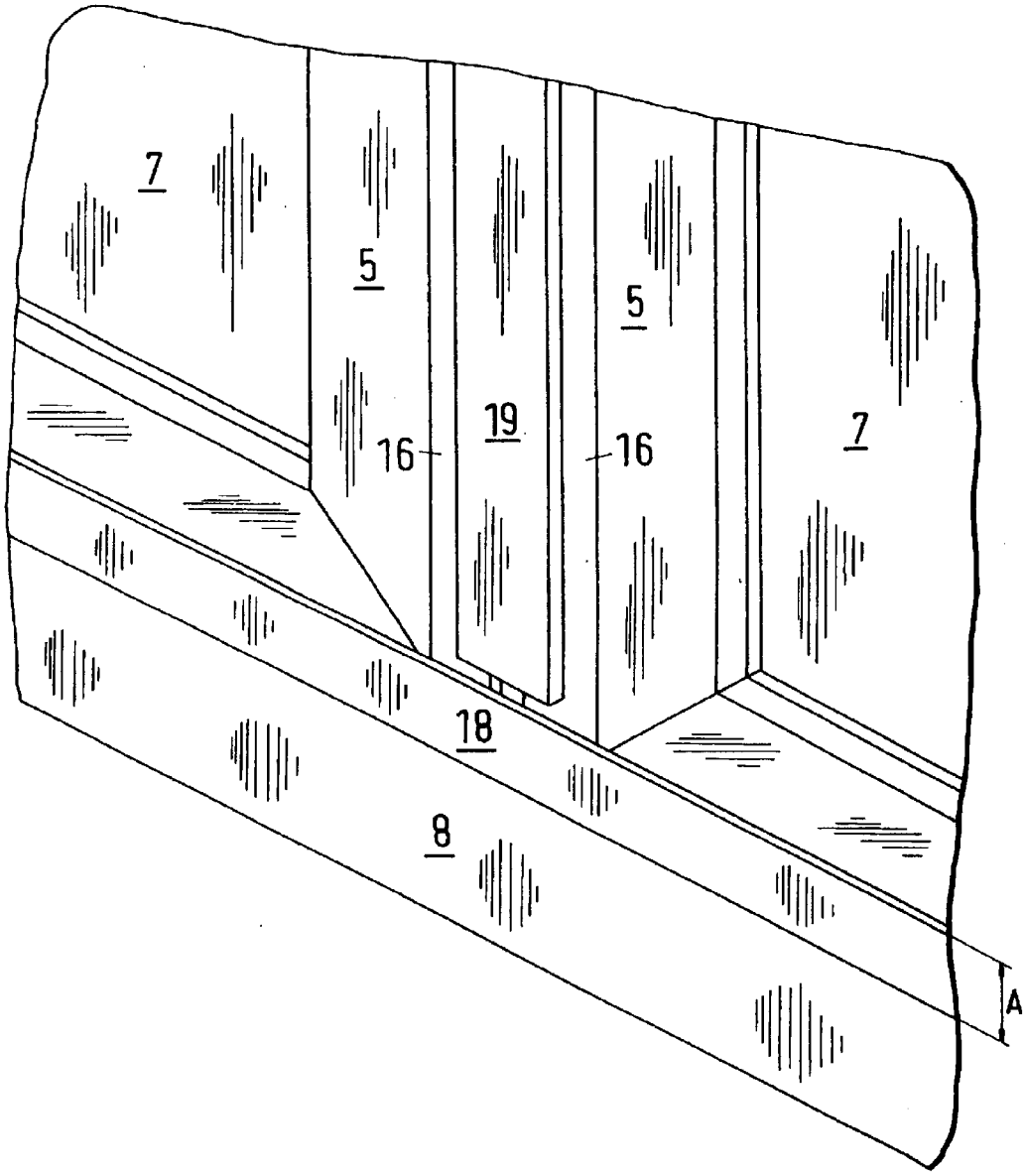
FIG. 5 shows the object of FIG. 3 in a view from the opposite exterior side viewed in a direction of arrow V of FIG. 3.
Figure 6:
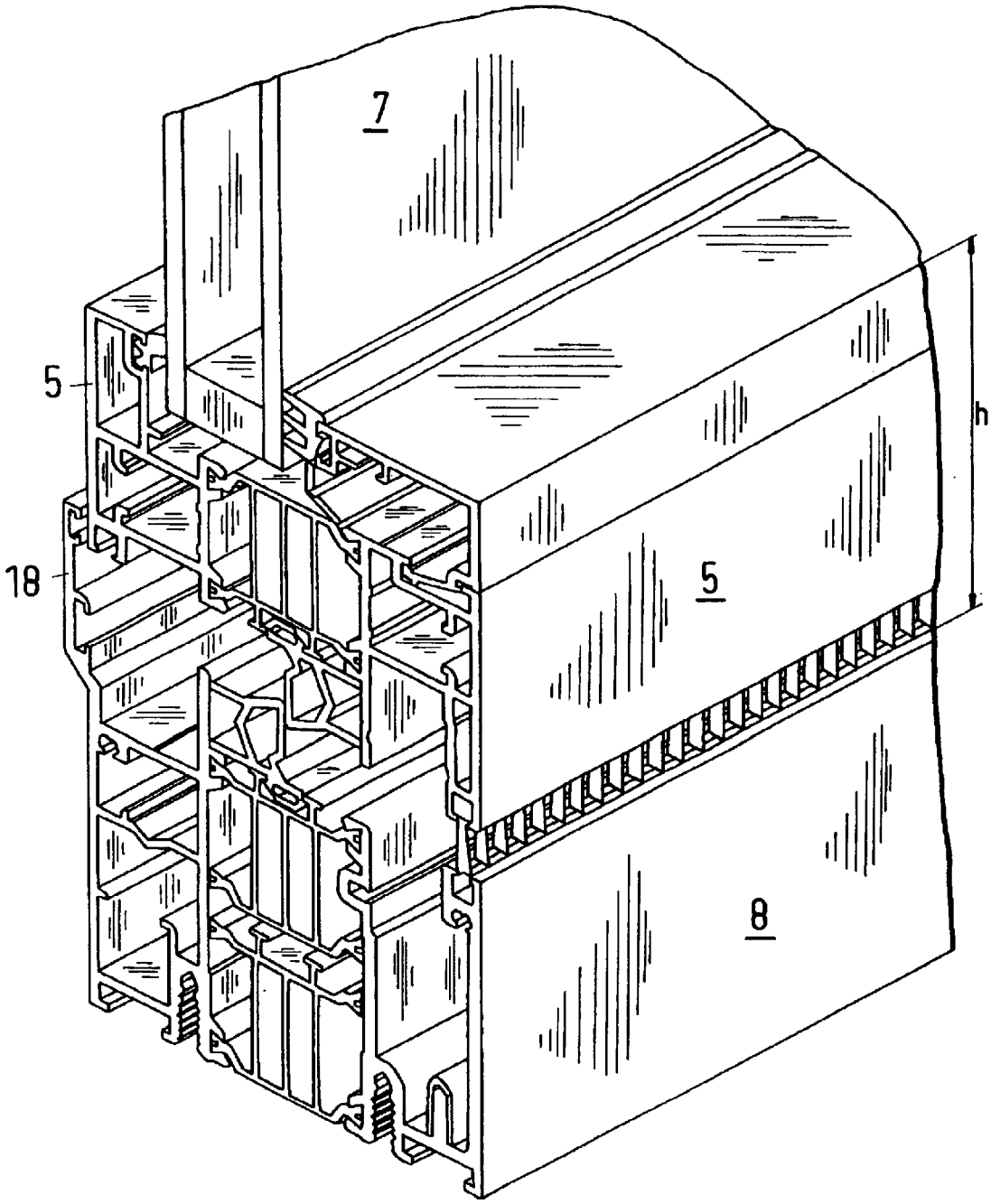
FIG. 6 is a magnified view of the detail VI of FIG. 2.

For burglary-proofing the device and for preventing draft, the folding device can have a raised stop 18, illustrated in particular in FIGS. 5 and 6. It is arranged on the side of the guide rail 8 opposite the opening side and the wings cannot move past it. In order to prevent that the profiled strips 16 of the opening wings 1, which upon opening movement pivot about the central axis 14 of the hinge 11 guide element, do not collide with the stop 18, the profiled strips 16 are slanted in the direction toward the free wing edge 3 at least in the area of the stop 18, i.e., across the height A of the stop 18. Preferably, this slanted portion, as in the illustrated embodiment, is configured as a rounded portion having a radius R having its point of origin approximately at the hinge axis 14 of the corresponding guide element 10. In order to design this configuration on the side of the stop 18 visually as inconspicuous as possible, at least one profiled strip 16 has preferably a cover strip 19 in the inner opening height between the stop 18 and the opposite guide rail (not illustrated), or—if present—a second stop, wherein the cover strip 19 covers the slanted or rounded portion at least partially. The cover strip 19 increases also the safety with respect to burglary attempts because points of attack for burglary tools are covered. Also, this cover strip 19 can reduce draftiness. FIG. 5 shows a view with the cover strip 19 viewed from the side of the stop 18. When two opening wings 1 abut one another, as in the illustrated embodiment of FIGS. 1 through 8, it is advantageous to provide the cover strip 19 only on one of the opening wings 1 and to design it to have such a width that it covers or overlaps also the profiled strip 16 of the neighboring opening wing 1.

Figure 7:
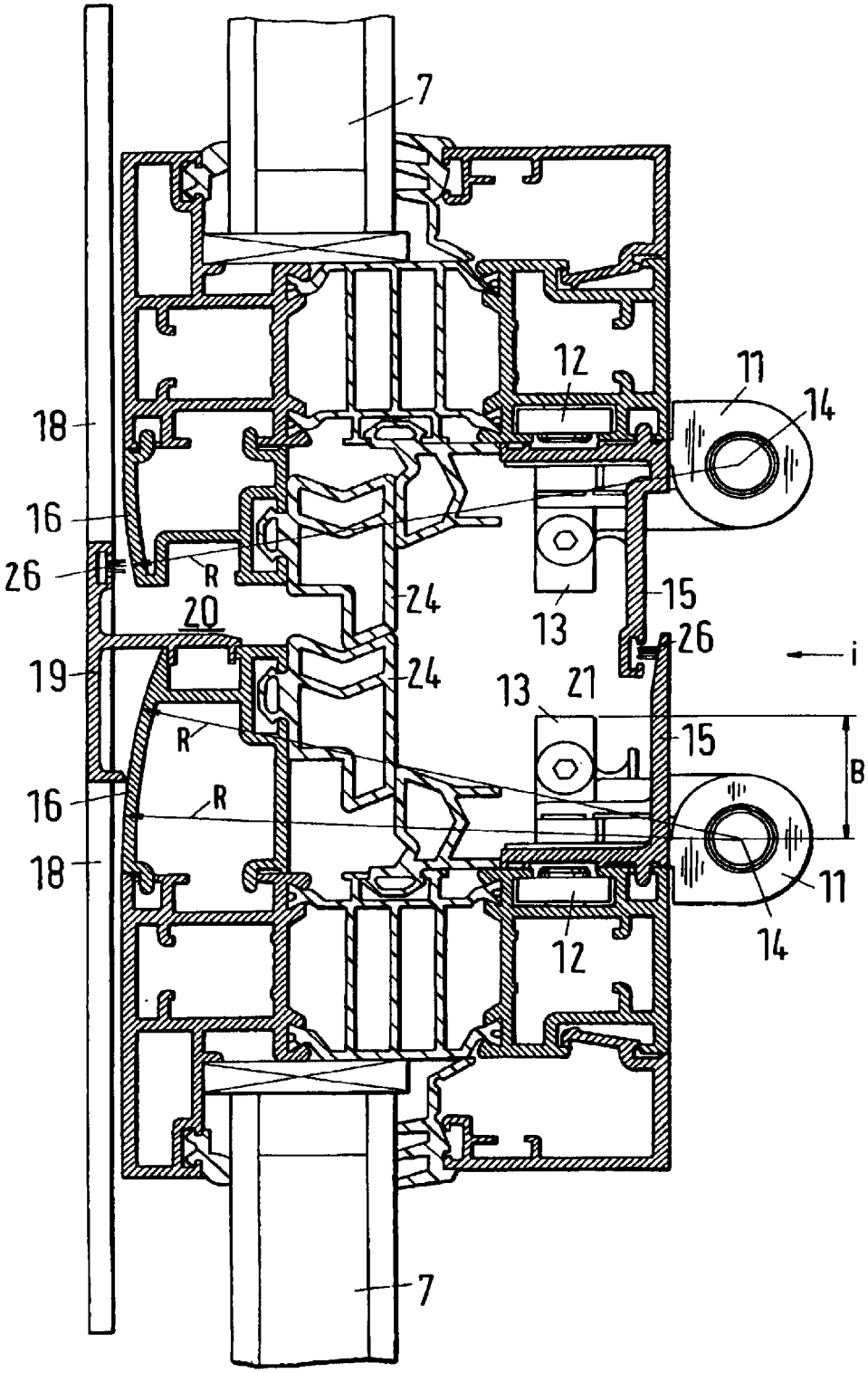
FIG. 7 is a section in the direction VII—VII of the object of FIG. 2.

The illustrated folding device has as a result of the alternatingly arranged hinges provided on the inner and outer sides its greatest width not in the completely closed state according to FIG. 7 but in the slightly open state according to FIG. 8 when the hinges 11 are aligned with one another. Upon opening of the folding device, the wing chain first becomes wider before the opening action actually takes place. This widening of the device upon opening is referred to as negative travel because the travel first occurs counter to the actual opening direction. In order to be able to compensate this negative travel, the profiled strips 15, 16 of the device according to the invention are configured such that they have a free space 20, 21 which allows movement of the previously closed opening wings 1 in the direction of its free wing edge 3. In this way, the wing pair to be opened can move into the free spaces 20, 21 available at the neighboring wing. When the opening wing 1 is arranged at a lateral frame 22 (see FIG. 10), the required free spaces enabling movement of the wing can also be provided within the lateral frame 22.

Figure 8A:
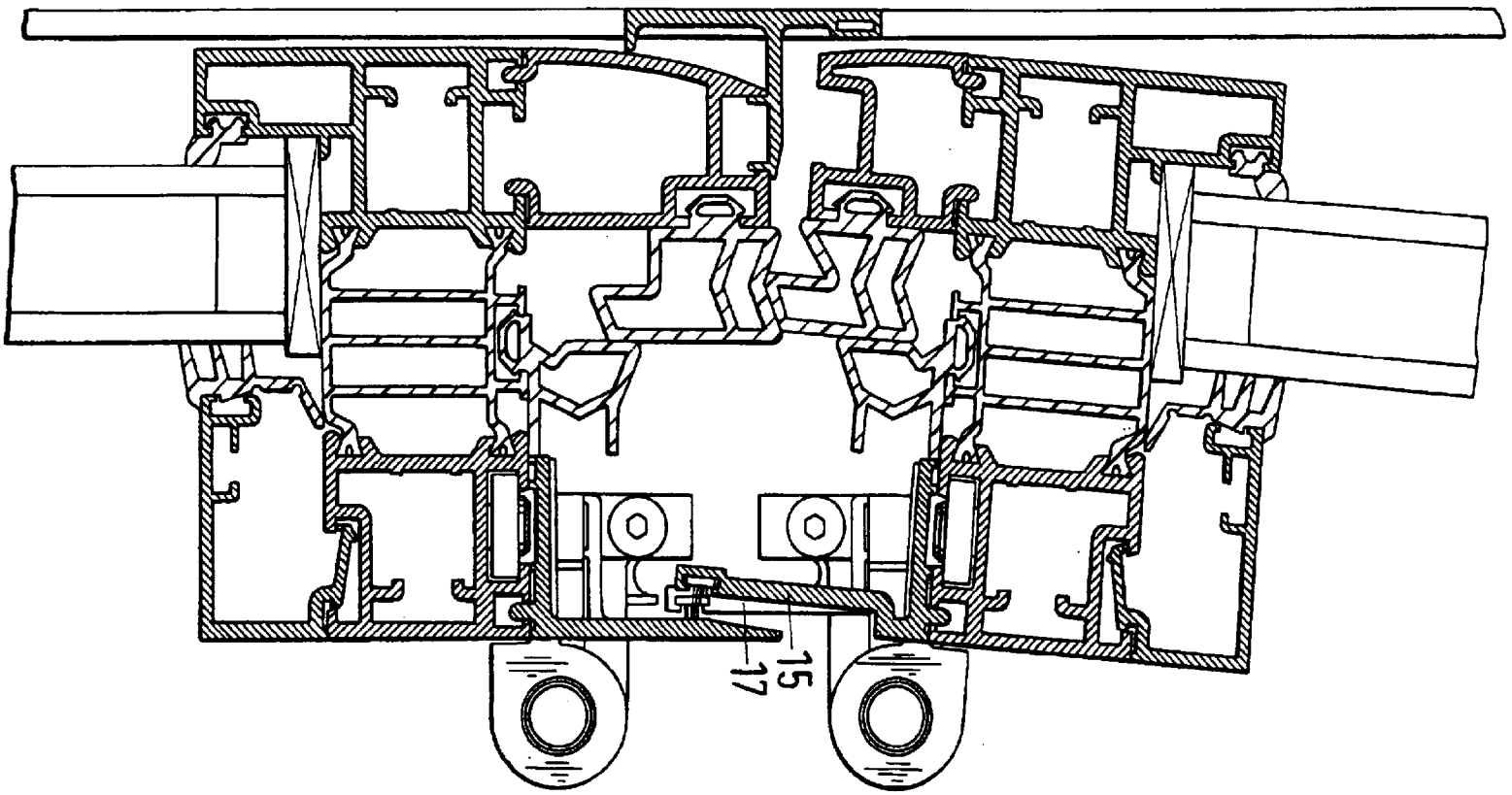
FIGS. 8*a–c* show the object of FIG. 7 in different positions when opening a wing.
Figure 8B:
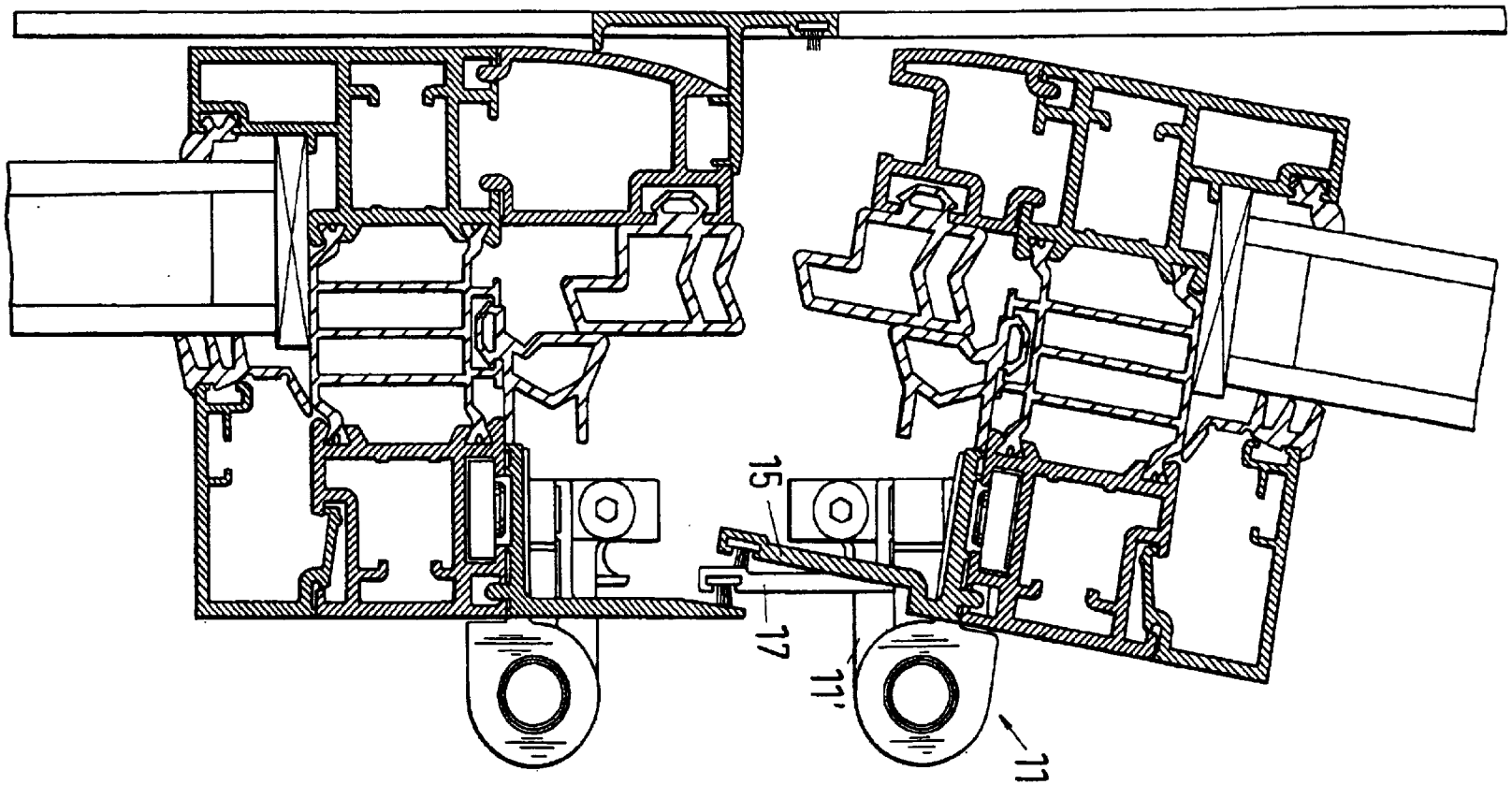
Figure 8C:
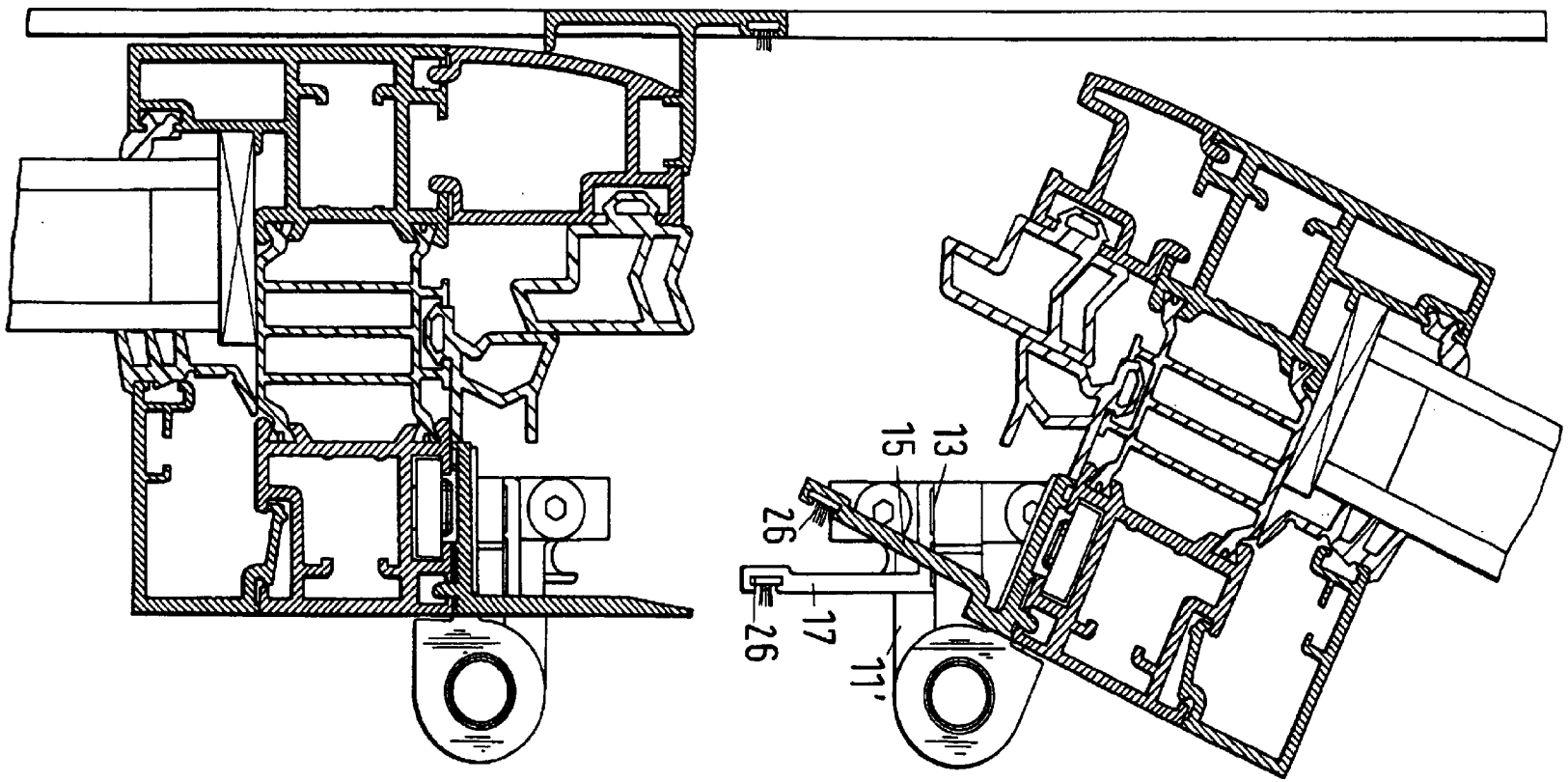

In order to ensure, despite these free spaces 20, 21, that there is no draft, it is advantageous to provide on at least one of the profiled strips 15, 16 a flexible seal 24 which at least partially fills the free space 20, 21. In the illustrated embodiment of FIGS. 7 and 8*a*–8*c*, the two opening wings 1 have rubber seals 24 which, when the wings open, deform to compensate the negative travel, as illustrated in FIG. 8*a*. The profiled strip 15 on the side facing the guide elements 10, the strip parts 17, and the cover strip 19 are to be sealed relative to the neighboring opening wing 1 or the lateral frame 22 preferably by brush seals 26. The profiled strips 15, 16 and/or the strip parts 17 themselves can be flexible, in particular, they can be embodied as sealing elements.

FIGS. 9 and 10 show different embodiments of the invention in which a wing pair 1 meets a lateral frame 22 (FIGS. 9*a*–9*f*) and a wing pair 1 meets a rotary wing 2 (FIGS. 10*a*–10*d*). Identical elements are indicated in these Figures with the same reference numerals as in FIGS. 1 through 8.

Figure 9A:
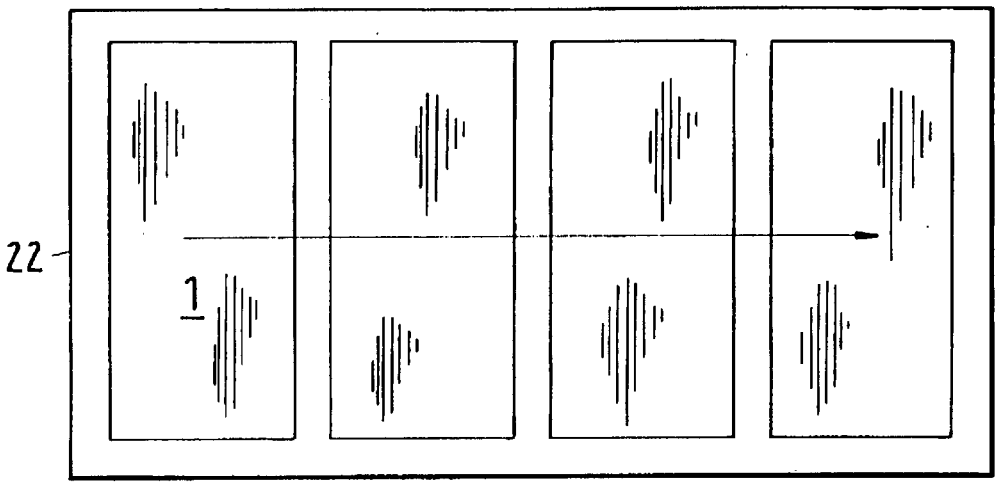
FIGS. 9*a–f* show a different embodiment with a wing pair meeting a lateral frame in views corresponding to the views of FIGS. 1, 7, and 8.
Figure 9B:
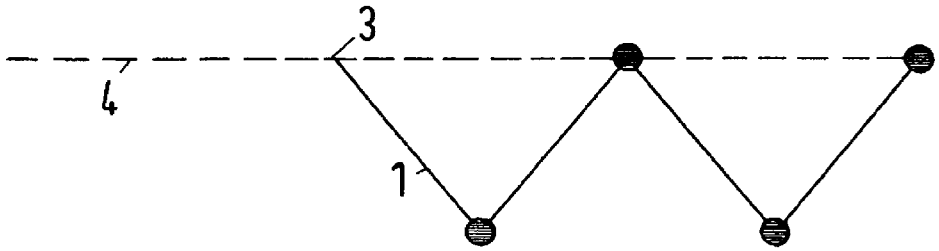
Figure 9C:
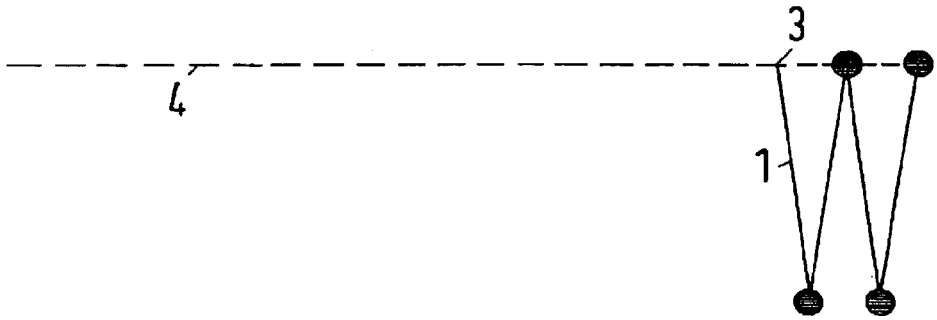
Figure 9D:
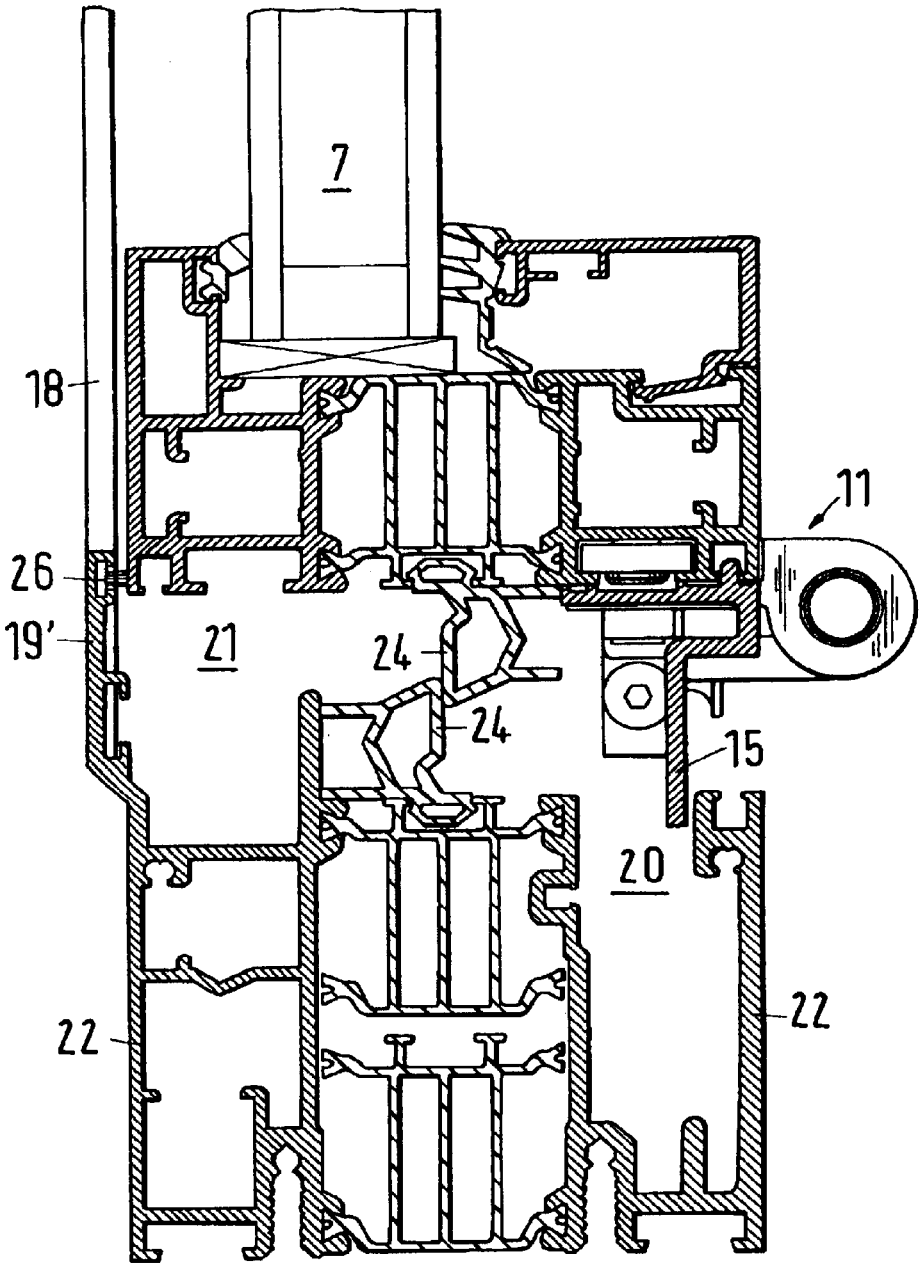
Figure 9E:
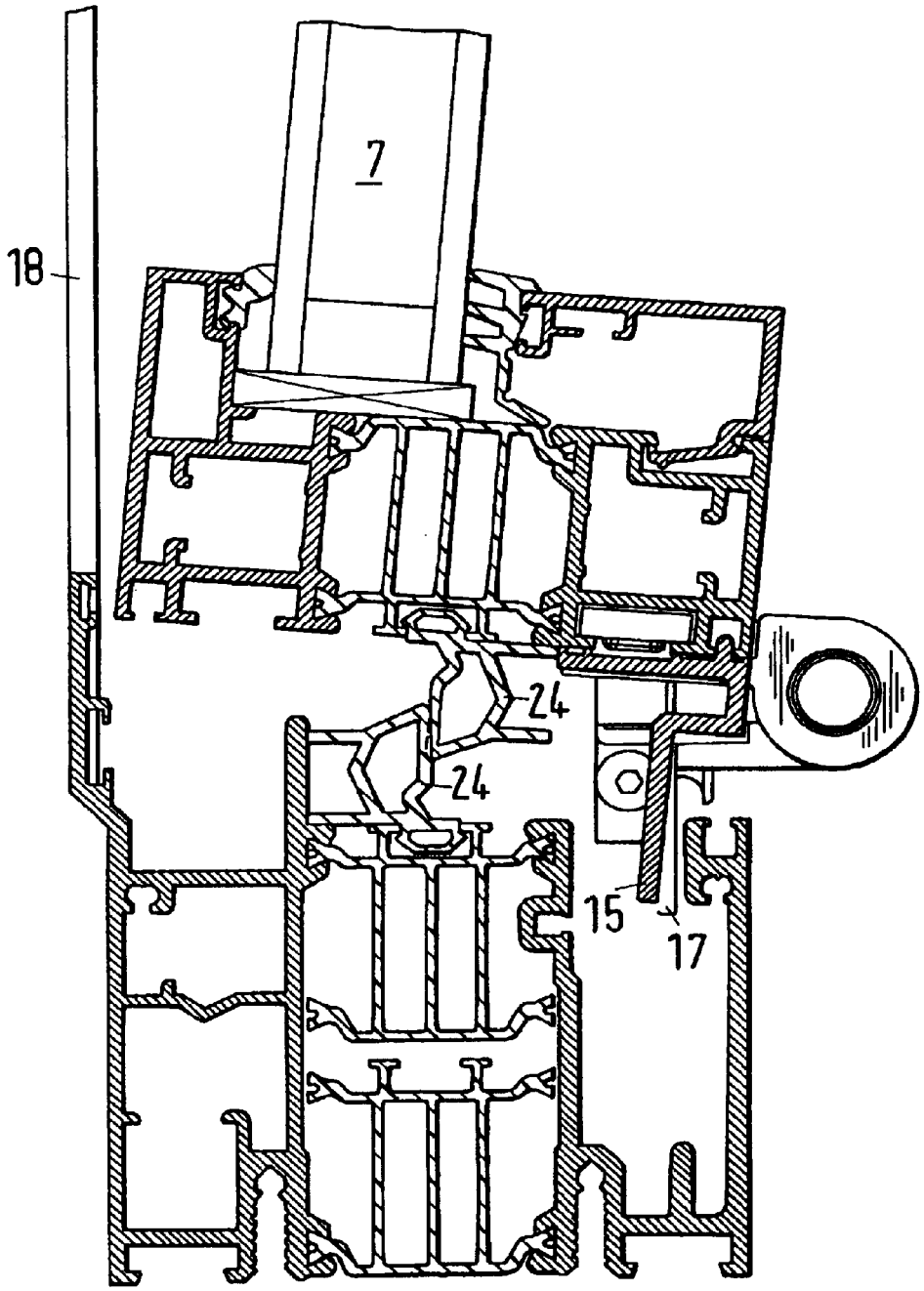
Figure 9F:
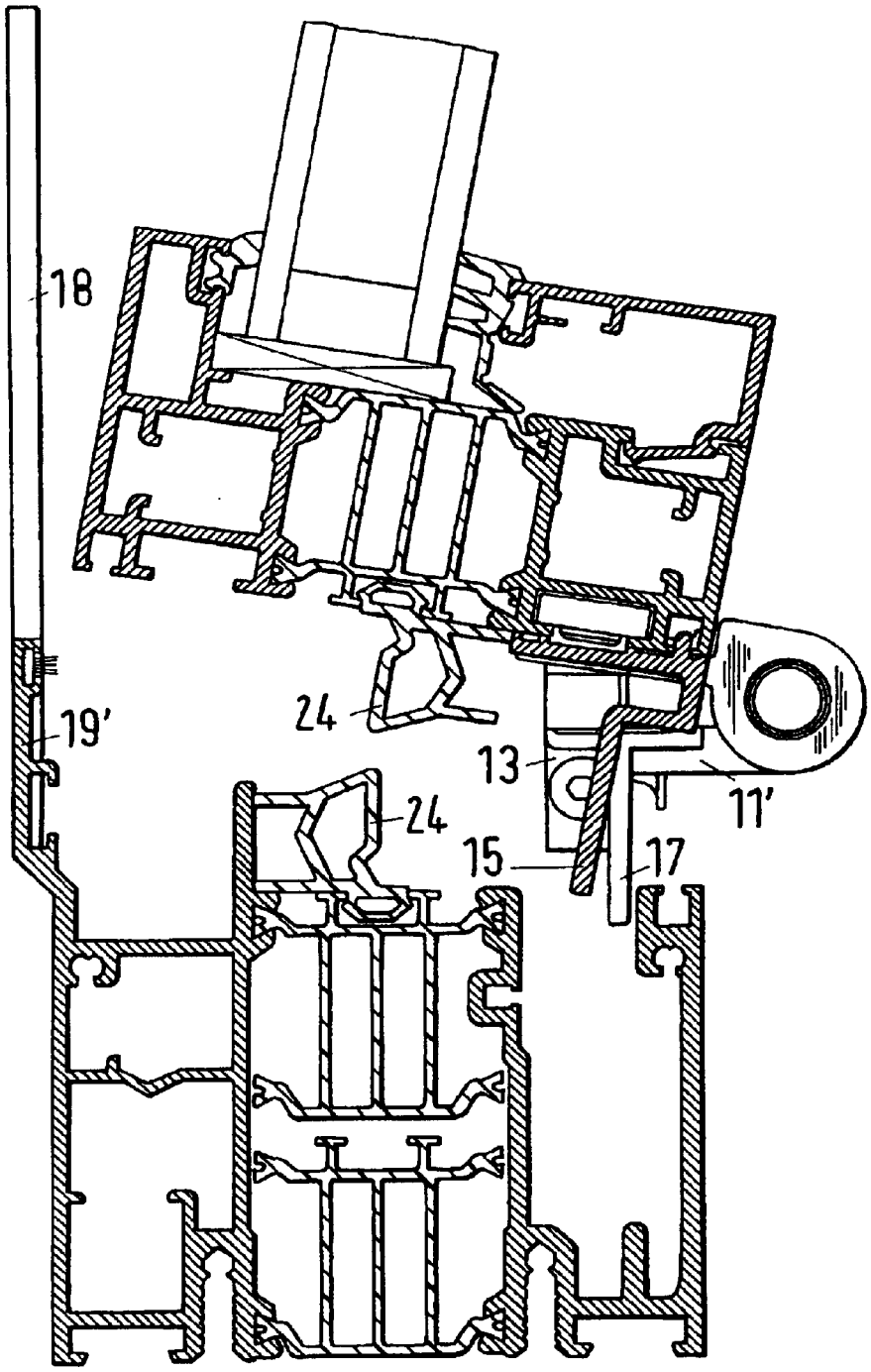

In FIGS. 9*a*–9*c*, a pictogram corresponding to FIGS. 1*a* to 1*e* illustrates the opening action of a four-wing folding device having a wing pair 1 that meets on the left side the lateral frame 22. FIG. 9*d* shows a section of the lateral frame 22 and the adjoining opening wing 1 corresponding to the illustration of the first embodiment in FIG. 7. FIGS. 9*e* and 9*f* shows the further opening action of this configuration corresponding to the illustrations of FIGS. 8*a* and 8*c*. The opening wing 1 of this configuration has only an inner profiled strip 15 and strip parts 17. The outer profiled strip is not needed because on the lateral frame 22 a covering strip 19', corresponding to the cover strip 19, is provided. For simplifying the drawing, the flexible seals 24 are illustrated in overlapped position in FIG. 9*e*. In practice, they deform, of course, in the same way as in the embodiment according to FIGS. 1 through 8.

Figure 10A:
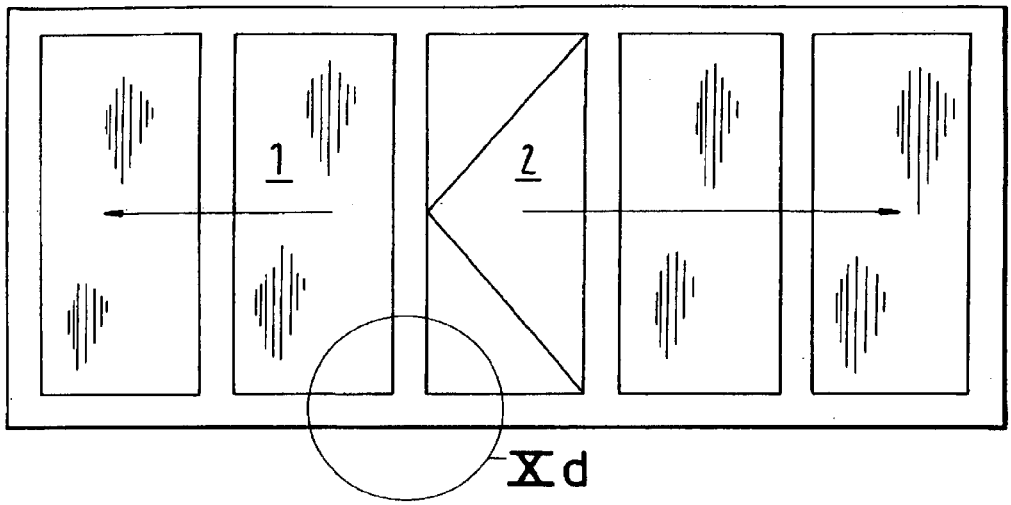
FIG. 10*a–d* show a different embodiment with a wing pair meeting a rotary wing in views corresponding to FIGS. 1, 7 and 8.
Figure 10B:
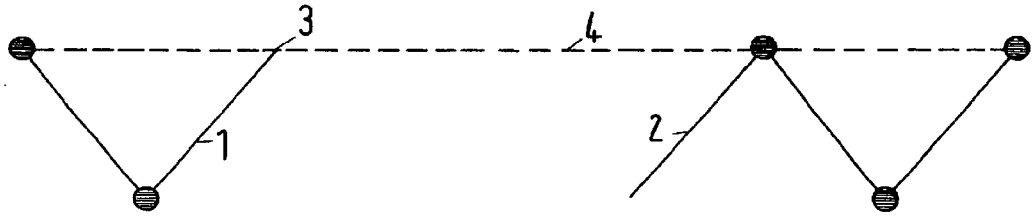
Figure 10C:
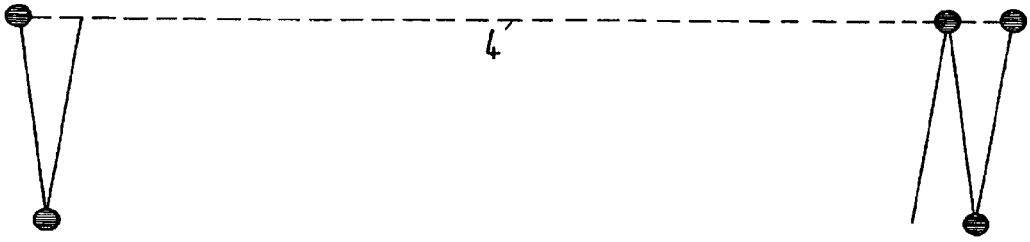
Figure 10D:
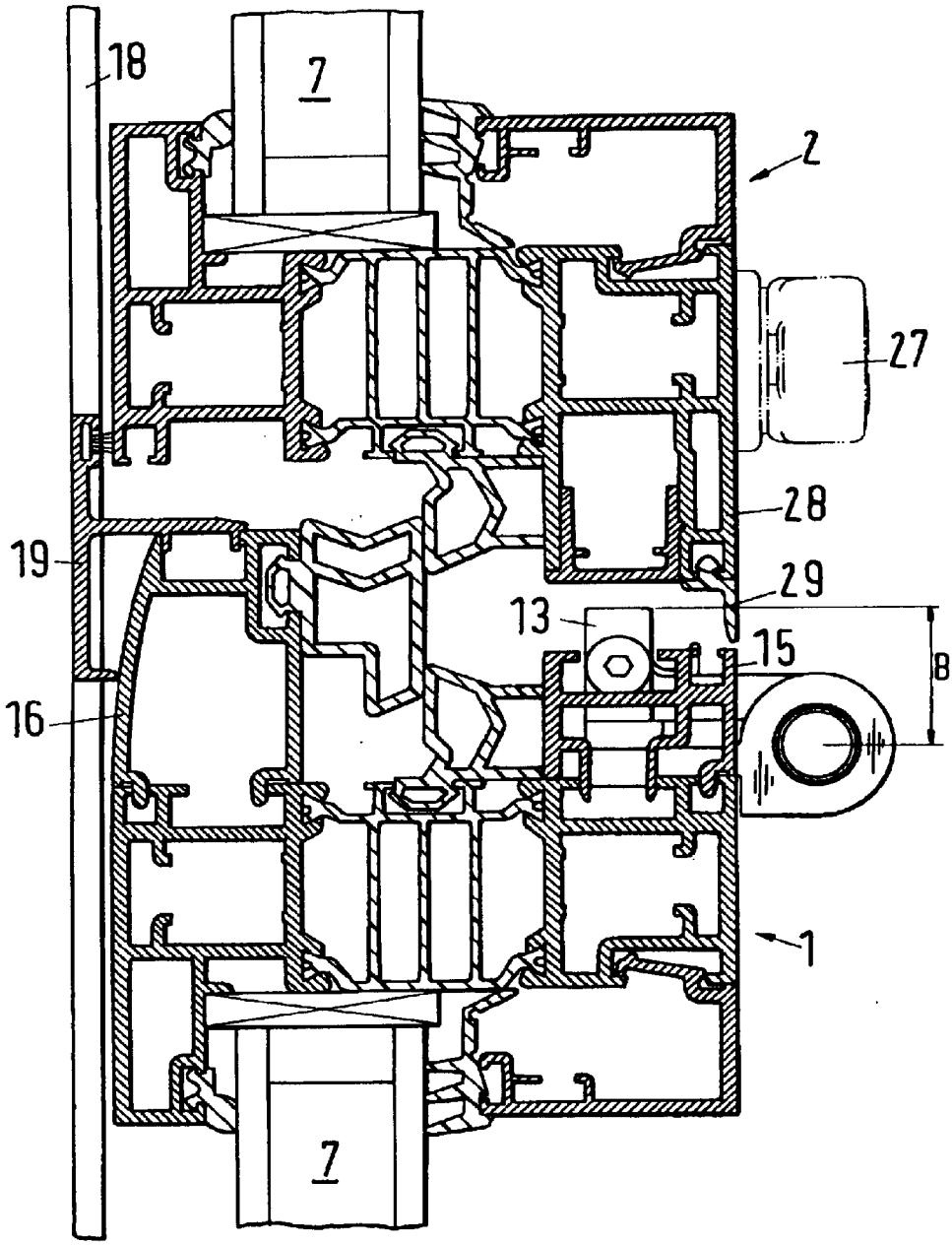
Figure 11:
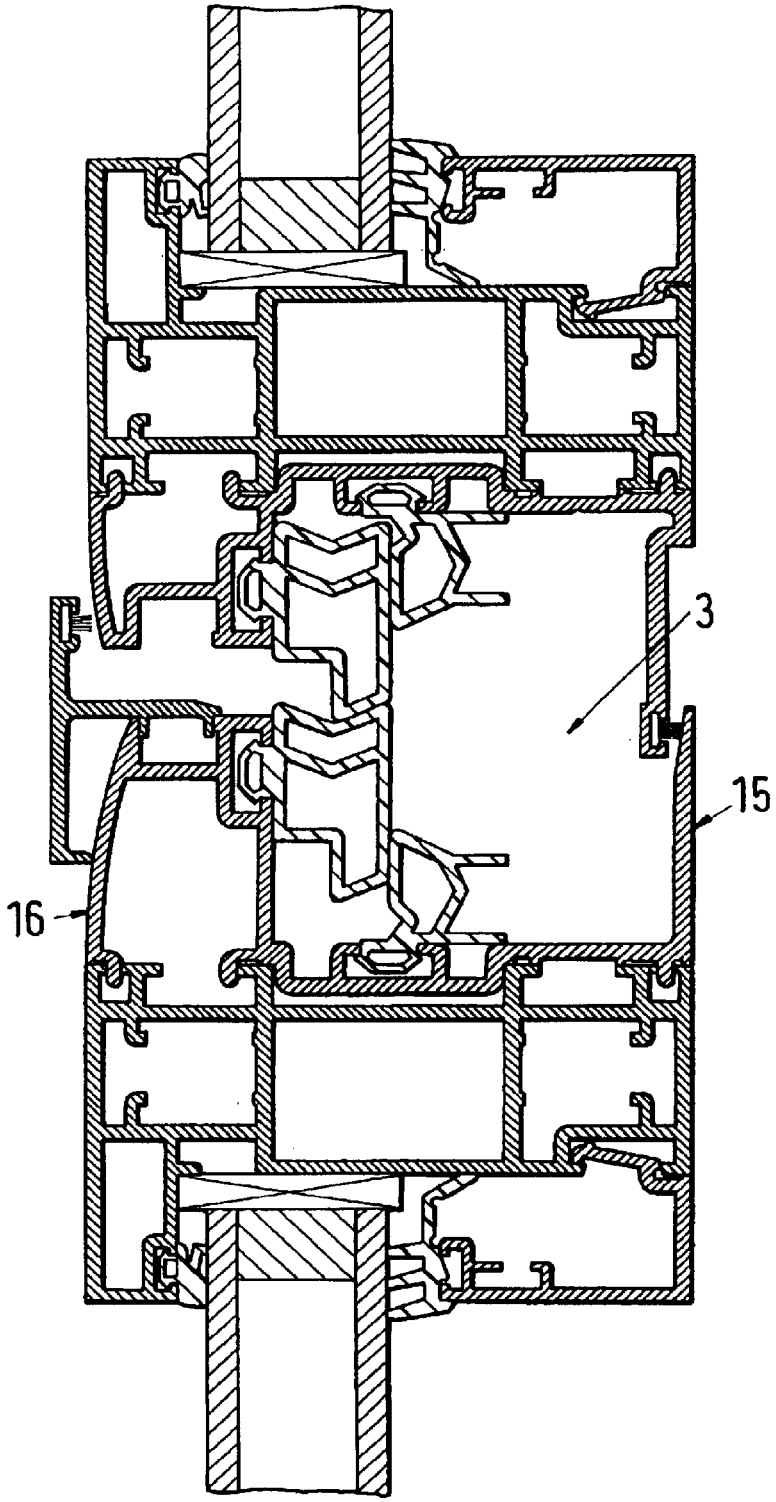
FIG. 11 shows first and second profiled strips and the free wing edge forming a monolithic part.

FIGS. 10*a*–10*c* shows, in a pictogram illustration corresponding to FIGS. 1*a*–1*e*, a five-wing folding device with a wing pair 1 and a rotary wing 2 meeting one another in the opening area. FIG. 10*d* shows a cross section of the opening area Xd of FIG. 10*a* corresponding to FIGS. 7 and 9*d*. Opening of this folding device is not illustrated in additional figures because when a wing 1 of a wing pair meets a rotary wing 2, generally the rotary wing is first pivoted by actuation of the handle 27, as illustrated in FIGS. 10*a*–10*c*. In the embodiment according to FIGS. 10*a* through 10*d*, the gap between the wing 1 of the wing pair and the rotary wing 2 on the inner side is covered substantially by a corresponding widened portion 28 of the rotary wing profile with sealing lips 29 so that the profiled strip 15 of the wing of the wing pair, i.e., opening wing 1, in this embodiment can be slim and must not cover entirely the width B of the holding element 13.

The folding device according to the invention is characterized in all configurations by a visually light appearance while providing high stability and—in the case of a folding device with glass panes—a high transparency and a minimal view obstructing portion or width. When opening the folding device, the profiled strips 15 and 16 as well as the cover strip 19 are pivoted together with the opening wing 1 without leaving behind a post as is conventional in the plane 14. Only the holding elements 13 of a minimal height provide the connection to the guide rails 8. They do not impair however the optical transparency of the device because of their minimal height.

While specific embodiments of the invention have been shown and described in detail to illustrate the inventive principles, it will be understood that the invention may be embodied otherwise without departing from such principles.

What is claimed is:

1. A folding device as a room divider or room closure, comprising:

at least one wing chain comprised of wings pivotably connected to one another such that the wings upon opening of the folding device are folded against one another;

wherein the wings have guide elements connected to one side of the wings, respectively, or are pivotably secured on a lateral frame;

a first guide rail and a second guide rail (8) receiving the guide elements (10) such that the wings are slidably guided in the first and second guide rails (8);

wherein at least one or the wings of the at least one wing chain is an opening wing (1) connected only to a single neighboring wing and has a free wing edge (3) guided in the first and second guide rails (8);

holding elements (13) arranged in the first and second guide rails (8), respectively, so as to have portions positioned outside the first and second guide rails, wherein the portions have a width in a longitudinal direction of the first and second guide rails;

wherein the guide elements (10) on the free wing edge (3) of the opening wing (1) have a hinge (11), respectively, wherein the hinges (11) have a first end connected to the opening wing (1) and a second end connected to one of the holding elements (13), wherein the free wing edge (3) has a first profiled strip (15) arranged between the holding elements (13) and immobile relative to the opening wing (1), wherein the first profiled strip (15) is configured to cover at least the width of the portions of the holding elements (13) position outside of the first and second guide rails (8).

2. The folding device according to claim 1, further comprising a second profiled strip (16), wherein the first profiled strip (15) is arranged on a first side of the opening wing (1), wherein the hinges (11) are located on the first side, and wherein the second profiled strip (16) is arranged on a second side of the opening wing (1) opposite the first side.

3. The folding device according to claim 2, wherein the first and second profiled strips (15, 16) form a monolithic part.

4. The folding device according to claim 2, wherein at least one of the first and second profiled strips (15, 16) is formed as a monolithic part of the tree wing edge (3).

5. The folding device according to claim 2, wherein the holding elements (13) and the hinges (11) form a monolithic part.

6. The folding device according to claim 2, wherein a height of the holding elements (13) matches maximally a height of a hinge part (11) of the hinges (11) facing the guide rails (8).

7. The folding device according to claim 2, wherein the holding elements (13) have strip parts (17) configured to match in a plan view a shape of the first profiled strip (15).

8. The folding device according to claim 7, wherein at least one of the first and second profiled strips (15, 16) and the strip parts (17) is a flexible element.

9. The folding device according to claim 8, wherein the flexible element is a sealing element.

10. The folding device according to claim 7, wherein at least one of the first and second profiled strips (15, 16) and the strip parts (17) has a seal (26) for sealing relative to a neighboring opening wing (1) or the lateral frame (22).

11. The folding device according to claim 2, wherein at least the first guide rail has a raised stop (18) on one longitudinal side, wherein the wings cannot move past the raised stop (18), wherein the second profiled strip (16) has a slanted portion facing the raised stop (18) and slanted in direction toward the free wing edge (3), wherein the slanted portion extends at least across a height (A) of the raised stop (18).

12. The folding device according to claim 11, wherein the slanted portion of the second profiled strip (16) is a rounded portion having a radius (R) originating at an axis (14) of the hinge (11).

13. The folding device according to claim 11, wherein at least one of the second profiled strips (16) of two of the opening wings (1) meeting one another in a closed position of the folding device has a cover strip (19) extending across an opening height of the folding device between the raised stop (18) and the second guide rail (8) or between the raised stop (18) and an additional raised stop provided on the second guide rail (8), wherein the cover strip (19) covers at least partially the slanted portion of the second profiled strip (16).

14. The folding device according to claim 13, wherein the cover strip (19), when the folding device is closed (1) covers also the second profiled strip (18) of the neighboring opening wing (1) in the dosed position.

15. The folding device according to claim 13, wherein at least one of the first and second profiled strips (15, 16) and the cover strip (19) has a seal (28) for sealing relative to the neighboring opening wing (1) in th closed position or a lateral frame (22).

16. The folding device according to claim 2, wherein the first and second profiled strips (15, 16) have a free space (20, 21) allowing, when opening the folding device, a movement of the opening wings (1) in a direction toward the free wing edge (3).

17. The folding device according to claim 16, wherein the free wing edge (3) has a flexible seal (24) filling at least partially the free space (20, 21).

* * * * *